US005165862A

United States Patent [19]

Lindblom

[11] Patent Number: 5,165,862

[45] Date of Patent: Nov. 24, 1992

[54] LOADING MACHINE EQUIPPED WITH A FIRST AND A SECOND PUMP SUPPLYING PRESSURE OIL TO AT LEAST ONE HYDRAULICALLY DRIVEN WORKING COMPONENT, SUCH AS A HYDRAULIC PISTON-CYLINDER DEVICE OR HYDRAULIC MOTOR

[75] Inventor: Sture Lindblom, Eskilstuna, Sweden

[73] Assignee: VME Industries Sweden AB, Eskilstuna, Sweden

[21] Appl. No.: 778,944

[22] PCT Filed: Jun. 19, 1990

[86] PCT No.: PCT/SE90/00435

§ 371 Date: Dec. 17, 1991

§ 102(e) Date: Dec. 17, 1991

[87] PCT Pub. No.: WO90/15931

PCT Pub. Date: Dec. 27, 1990

[30] Foreign Application Priority Data

Jun. 21, 1989 [SE] Sweden ..... 8902253

[51] Int. Cl.[5] ..... F04B 49/00

[52] U.S. Cl. ..... 417/216; 417/287

[58] Field of Search ..... 417/428, 426, 286, 287, 417/216

[56] References Cited

U.S. PATENT DOCUMENTS

| | | | |
|---|---|---|---|
| 3,526,468 | 9/1970 | Moon et al. | 417/287 |
| 3,947,194 | 3/1976 | Schlecht | 417/212 |
| 3,985,472 | 10/1976 | Virtue et al. | 417/426 X |
| 4,382,485 | 5/1983 | Kirkham | 417/216 |

*Primary Examiner*—Leonard E. Smith

*Attorney, Agent, or Firm*—Young & Thompson

[57] ABSTRACT

A loading machine equipped with a first and a second pump for supplying hydraulic oil to at least one hydraulic operated working component, such as a hydraulic piston-cylinder device or a hydraulic motor having a varying oil-pressure and flow requirement, wherein the pumps can be connected together for mutual coaction, when necessary. The second, larger pump is a fixed displacement pump. The first pump is provided with a pump regulator which is influenced by the load pressure prevailing in the hydraulic system and is intended to influence the first pump in a manner to maintain between the outlet of the pump and the load pressure on the pump regulator a pressure difference determined by the pump regulator, wherein the first pump is connected to the working component via a variable restriction. A control device is operative to connect the second and larger pump to the system solely when there is a need for a smooth increase in flow which cannot be achieved solely by the first pump.

3 Claims, 3 Drawing Sheets

LOADING MACHINE EQUIPPED WITH A FIRST AND A SECOND PUMP SUPPLYING PRESSURE OIL TO AT LEAST ONE HYDRAULICALLY DRIVEN WORKING COMPONENT, SUCH AS A HYDRAULIC PISTON-CYLINDER DEVICE OR HYDRAULIC MOTOR

The present invention relates to a loading machine which is equipped with two pumps which function to supply hydraulic oil to at least one hydraulically operated working component, such as a hydraulic piston-cylinder device or a hydraulic motor having variable oil-pressure and oil-flow requirements, wherein the pumps can be connected one with the other for mutual coaction, when necessary.

Some loading machines of this kind are equipped with two fixed displacement pumps instead of one large pump of fixed displacement. Fixed displacement pumps, however, result in relatively large throttle losses and consequently a single variable displacement pump is used in some instances. When a large variable displacement pump is required, however, the cost entailed is considerable and much higher than that entailed by two fixed displacement pumps intended for the same purpose.

In the case of one known machine equipped with two fixed displacement pumps, one of said pumps is able to produce a high hydraulic pressure and a small hydraulic flow, whereas the other pump is able to produce a lower hydraulic pressure and a larger hydraulic flow. The first pump is activated when a high fluid pressure and a relatively small fluid flow is required, and the second pump is isolated from the system, by coupling said pump to the tank. The second pump is also coupled to the system when a smaller hydraulic pressure but greater flow is required. Such requirements occur, for instance, in the case of relatively large loading machines equipped with lifting jibs and a bucket or shovel, e.g. machines intended for loading gravel removed from a gravel pit. When such a machine is driven into the gravel pit with the bucket or shovel in contact with the ground, maximum tractive force is required on the loader wheels in order to drive the shovel into the gravel and, in conjunction therewith, a large hydraulic force is required in the system in order to tilt the shovel upwards while filling the same. The need of a large force is great in this phase of a gravel shifting operation, whereas flow requirements are less pronounced. Subsequent raising of the jib requires less force, whereas the need for fluid flow is great, in order to achieve a relatively high lifting speed.

In known pump units comprising two pumps, the hydraulic system is required to work in a low pressure range and in a high pressure range. When the pressure developed by the first pump approaches the limit value, this is detected by a regulator device, which activates the second pump in response thereto. The drawback with this system, however, is that the large fixed displacement pump with associated throttle losses is brought into operation on those occasions when its larger flow capacity is not required. The known regulator or control device does not take this into account and the object of the invention is therefore to provide a loading machine with a regulator device which will eliminate this drawback, by causing the second and larger pump to be activated solely when there is a need for greater flow and when this need cannot be satisfied by the first pump alone.

This object is achieved with a loading machine constructed in accordance with the invention. The principle difference between the inventive regulator device and the known regulator device is that the inventive device is constructed to sense a region of low flow and a region of high flow, and at the border between these regions to connect-up both pumps in the system when there is a need for greater flow, so that the two pumps together will achieve the desired greater flow of hydraulic medium in the upper flow region.

Although it lies within the scope of the present invention for the first pump to be a fixed displacement pump, the pump is preferably a variable displacement pump provided with a known load-sensing pump regulator. When the first pump is a fixed displacement pump, the pump will be provided with a load-sensing pump regulator equipped with a shunt valve. The losses experienced with a fixed displacement pump are reduced, by keeping the dimensions of the pump small in relation to the second, larger pump.

The accompanying drawings illustrate schematically two embodiments of an inventive regulator device intended for use with loading machines of the kind concerned.

Figure 1:
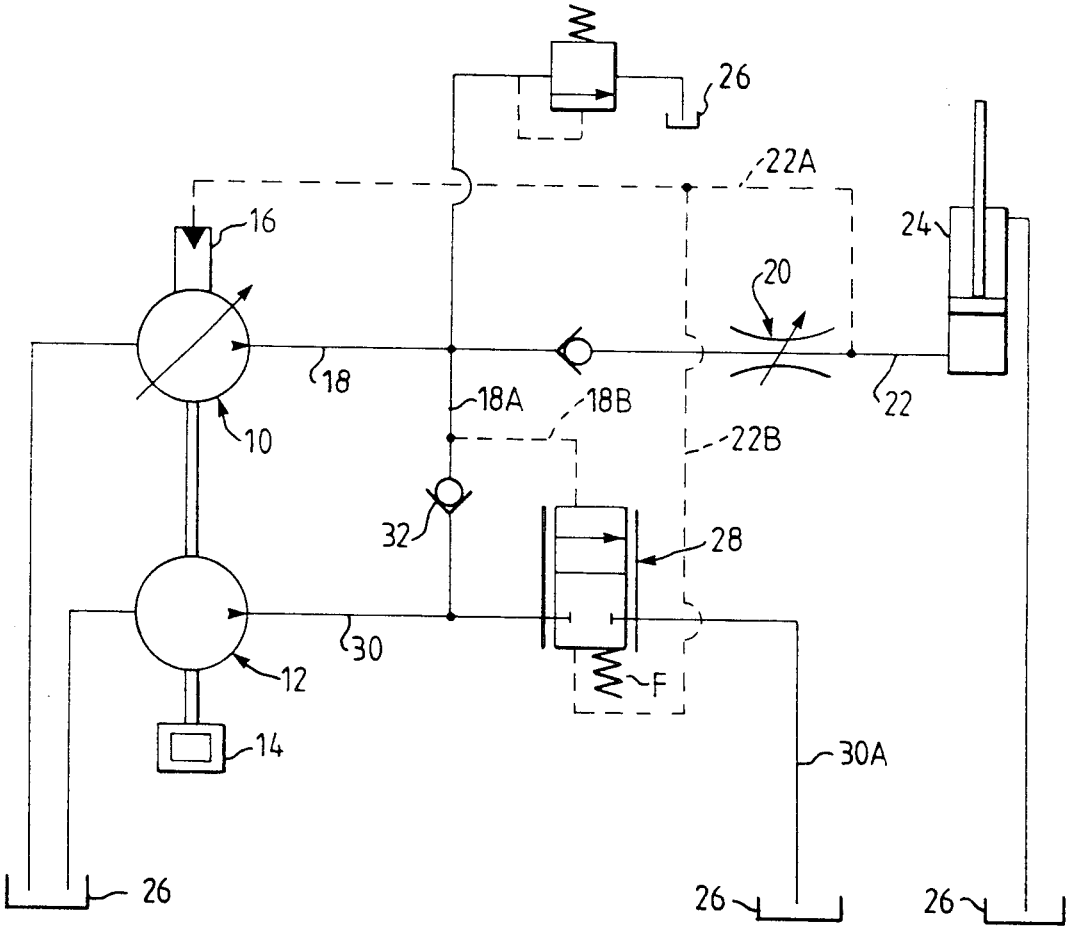
FIG. 1 illustrates a preferred embodiment comprising a variable displacement pump and a fixed displacement pump.

The reference numeral 10 identifies a variable displacement pump of, e.g., a known piston type, and the reference numeral 12 identifies a fixed displacement pump. The pump 10 is preferably much smaller than the pump 12.

The pumps are driven by the engine 14 of the loading machine.

Figure 2:
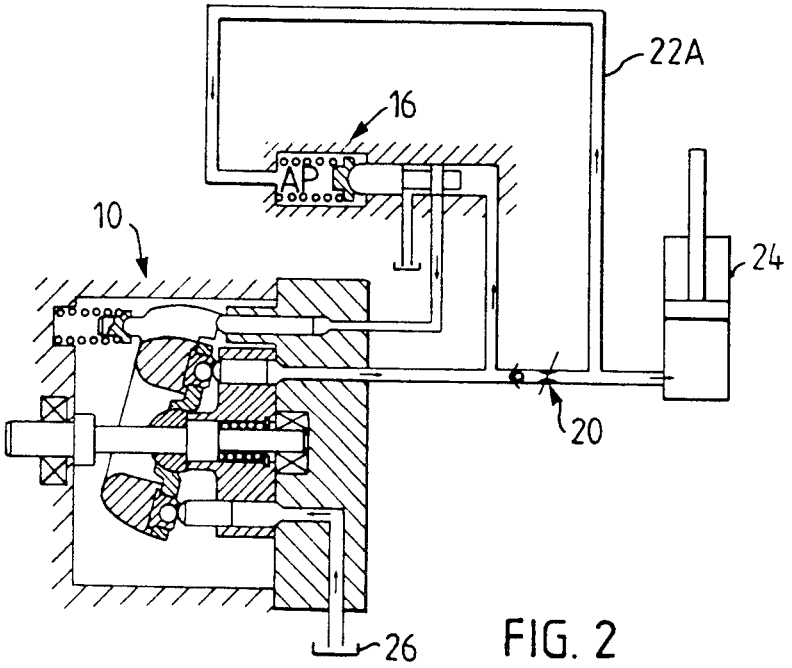
FIG. 2 is a more detailed illustration of the variable displacement pump used in the FIG. 1 embodiment and the load-sensing pump regulator.
Figure 3:
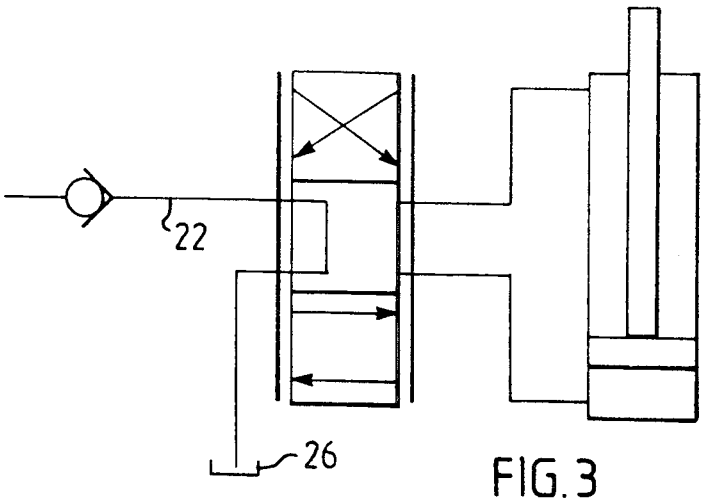
FIG. 3 is a detailed illustration of a double-acting piston-cylinder device connected in the system.

The pump 10 is provided with a load-sensing pump regulator 16 of known design, as illustrated schematically in FIG. 2.

The pump conduit 18 of the pump 10 is connected to a hydraulically operated hydraulic component, such as a hydraulic piston-cylinder device 24, by means of a smoothly adjustable throttle-valve 20 and a working conduit 22. The working conduit 22 is connected by means of a conduit **22*a* to the pump regulator 16**, which is set to a constant pressure difference PdP.

Lying over the throttle valve is a pressure difference dP which is normally equal to PdP, the pump pressure P being equal to the pressure difference dP + the load pressure PL.

When the flow requirement of the hydraulic piston-cylinder device 24 is greater than that which the pump 10 is able to deliver with a fully open valve 20, the pressure difference dP will fall. In accordance with the invention, this signal is utilized, in a simple manner, to activate the larger pump 12. The pump 12 is normally connected to the tank 26 via a smoothly adjustable control valve 28 when said valve is in its open position. The other side of the valve is connected to a working conduit 22B in which the pressure PL prevails, and is also influenced on said one side by a spring F which produces a force which is slightly smaller than the force exerted by pressure dP. The other side of the valve is influenced by the pump pressure P in the conduit 18, via the conduit 18*a*, 18*b*, i.e. PL + dP. When the flow from the pump 10 is not able to sustain the pressure difference dP across the throttle valve, the force PL + the spring force F will adjust the valve to its illustrated closed position. The pump 12 will then supply pressure oil through its pump conduit 30 and a check valve 32 to the pump conduit 18 so as to increase the flow through the throttle valve 20 to the hydraulic piston-cylinder device 24, therewith satisfying the higher flow demand of said device.

As will be seen from the aforegoing, the regulating device is a particularly simple device for achieving the desired result.

Figure 4:
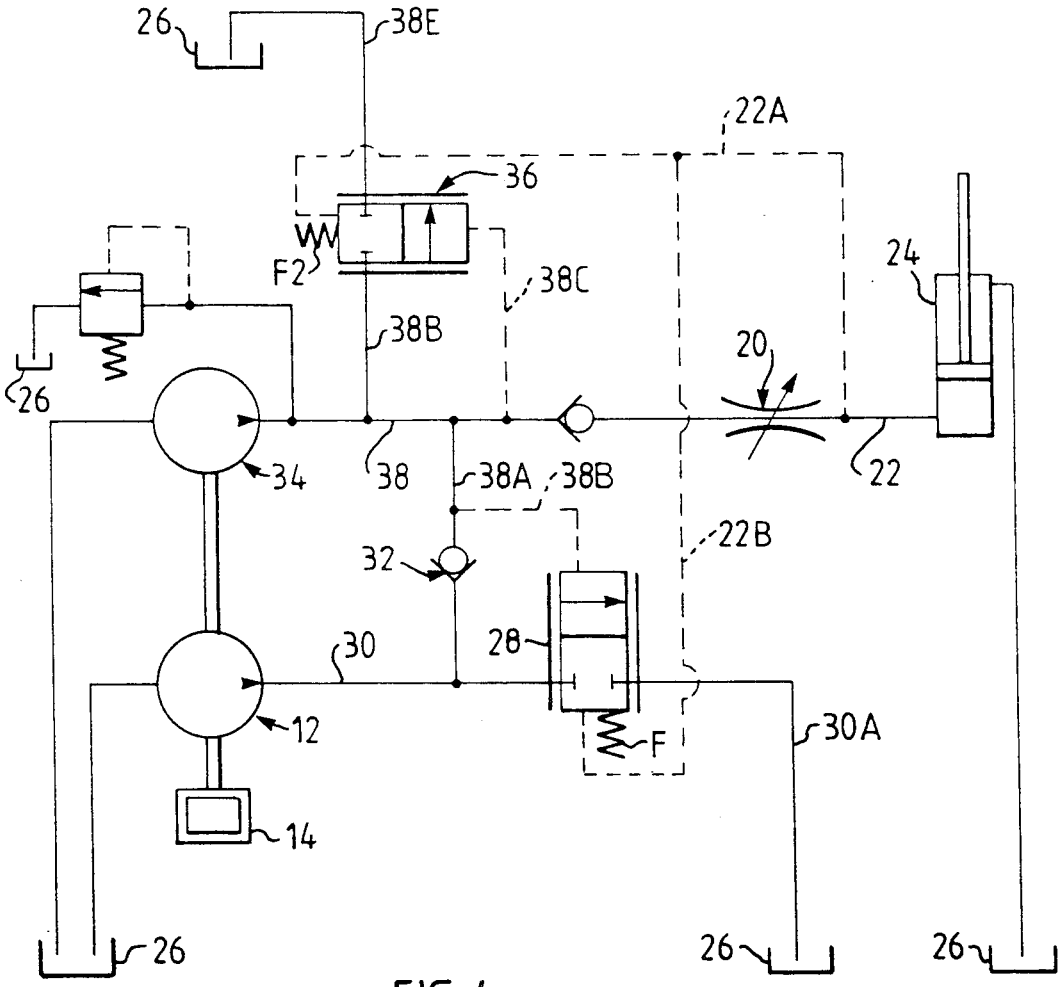
FIG. 4 illustrates the combination of a first fixed displacement pump and a second displacement pump, the pump regulator of the first pump being of a known kind and provided with a shunt valve.

Although the embodiment which incorporates a variable displacement, first pump 10 is to be preferred, the invention can also be applied in existing units which have two fixed displacement pumps, such as the unit illustrated in FIG. 4 in which the first pump 34 is also a fixed displacement pump. The unit comprises, in a known manner, a pump regulator having a load-sensing shunt valve 36 which reacts to changes in the pressure difference dP across the smoothly adjustable throttle valve 20.

The pump pressure P prevailing in the conduit 38, 38C acts on one side of the valve 36 and is equal to the load pressure PL prevailing in the conduit 22 plus the pressure difference PdP. The pressure difference PdP is set in the pump regulator with the spring F2, which acts on the other side of the valve, where the load pressure PL also acts via the conduit 22A.

When the valve 36 is open, the pump 34 is connected to the tank 26 through the conduit 38D, 38E.

The shunt valve 36 and the trottle valve 20 form a variable-setting volume-flow regulator in a known manner. This arrangement, however, results in relatively large losses which can be reduced considerably in accordance with the invention. In accordance with the invention, there is chosen a relatively small first pump 34 and the pump is combined with a larger fixed displacement pump 12 in the same manner as the variable displacement pump 10 of the FIG. 1 embodiment is combined with the fixed displacement pump 12.

When the pressure difference dP across the throttle valve falls and the pump 34 is no longer able to deliver the flow desired, the regulator valve 28 is switched to the illustrated closed position, similar to the FIG. 1 embodiment, so as to couple both pumps to the system and reestablish the predetermined pressure difference across the valve 20, while increasing the flow to the hydraulic piston-cylinder device 24 at the same time.

I claim:

1. A loading machine equipped with a first and a second pump for supplying hydraulic oil to at least one hydraulically driven working component, such as a hydraulic piston-cylinder device or a hydraulic motor having a varying oil-pressure and oil-flow requirement, wherein the two pumps can be connected together for mutual coaction when required, characterized in that the second pump is a fixed displacement pump; in that the first pump has a pump regulator which is influenced by the load pressure in the hydraulic system and which is intended to influence the first pump in a manner to maintain a pressure difference between the pump outlet and the load pressure to the pump regulator, said pressure difference being determined by said regulator; in that the first pump is connected to the working component via a variable throttle means wherein the pressure drop across the throttle is substantially constant so as to achieve the desired flow through different settings of the throttle valve within the capacity range of the first pump; in that the second pump is either connectable to the tank via a first connection through a smoothly adjustable control valve or, when said valve is closed, to the outlet conduit of the first pump via a conduit which incorporates a check valve and is connected to the pump conduit of the first pump upstream of the adjustable throttle valve; in that under normal operating conditions, said pressure drop is substantially equal to said pressure difference; in that the control valve is influenced at one end thereof by the pressure prevailing in the outlet conduit of the first pump, said pressure being equal to the load pressure plus said pressure difference such as to set the control valve to a first position for connection to the tank, and the other end of said control valve is influenced by the load pressure plus a spring force which is somewhat smaller than the force corresponding to a pressure equal to the pressure difference on the opposite end of the regulating valve, such that the valve will be switched from its first to its second position when the capacity of the first pump is insufficient to produce the desired pressure difference and flow, which causes the pressure difference in the outlet conduit of the first pump to fall to a level so low as to cause the valve to be switched to a position in which connection with the second pump to the tank is closed and the flow from said second pump is connected upstream of the throttle valve for continuous, smooth adjustment of the flow in an upper flow range while reestablishing the pressure difference across the throttle valve at the same time.

2. A machine according to claim 1, characterized in that the first pump is a variable displacement pump provided with a load-sensing pump regulator which maintains said pressure difference under normal conditions.

3. A machine according to claim 1, characterized in that the first pump is a fixed displacement pump, and in that the pump regulator includes a shunt valve for maintaining said pressure difference under normal conditions.

* * * * *